US007020576B2

(12) United States Patent
Alowonle et al.

(10) Patent No.: US 7,020,576 B2
(45) Date of Patent: Mar. 28, 2006

(54) BACK EMF ACTUATOR CONTROL

(75) Inventors: Musibau O. Alowonle, Brooklyn Park, MN (US); Bruce Phillip Bushey, Minneapolis, MN (US); Robert J. Erko, Apple Valley, MN (US); Paul Leonard Groschen, Jr., White Bear Lake, MN (US); Richard F. Milun, Corcoran, MN (US)

(73) Assignee: Tennant Company, Minneapolis, MN (US)

( * ) Notice: Subject to any disclaimer, the term of this patent is extended or adjusted under 35 U.S.C. 154(b) by 0 days.

(21) Appl. No.: 10/854,549

(22) Filed: May 26, 2004

(65) Prior Publication Data

US 2005/0267708 A1 Dec. 1, 2005

(51) Int. Cl.
*G01C 17/00* (2006.01)
*G01C 19/00* (2006.01)

(52) U.S. Cl. ..... 702/150; 15/49.1; 15/98

(58) Field of Classification Search ..... 702/149
See application file for complete search history.

(56) References Cited

U.S. PATENT DOCUMENTS

| | | | | |
|---|---|---|---|---|
| 5,847,530 | A * | 12/1998 | Hill | 318/599 |
| 6,000,084 | A * | 12/1999 | Briscoe | 15/49.1 |
| 6,163,915 | A * | 12/2000 | Kaczmarz et al. | 15/49.1 |
| 2004/0200017 | A1 * | 10/2004 | Crane et al. | 15/49.1 |
| 2004/0231947 | A1 * | 11/2004 | Baehr | 192/84.6 |

* cited by examiner

*Primary Examiner*—Bryan Bui
*Assistant Examiner*—Demetrius R. Pretlow
(74) *Attorney, Agent, or Firm*—Fulbright & Jaworski L.L.P.

(57) ABSTRACT

A control system for estimating the approximate relative position of an electric linear actuator on a surface maintenance machine. The control system includes device for selectively coupling the electric motor of the linear actuator to the electric power source, device for measuring or estimating the current and voltage of the electric motor, device for estimating the motor speed based on the measured values of current and voltage, and storage device for storing values of estimated motor speed and integrating device for determining approximate linear actuator position, wherein the integrating device integrates the motor speed over time to determine the approximate position of the linear actuator position.

14 Claims, 4 Drawing Sheets

BACK EMF ACTUATOR CONTROL

FIELD OF THE INVENTION

The present invention is directed to an apparatus and method of use for determining the approximate relative position of an actuator or tool controlled by the actuator and relates generally to surface maintenance or conditioning machines, and more particularly to those machines employing one or more surface maintenance or conditioning appliances or tools that perform one or more tasks including, among others, scrubbing, sweeping, and polishing or burnishing.

BACKGROUND OF THE INVENTION

Surface maintenance vehicles that perform a single surface maintenance or surface conditioning task are, of course, well known. Surface maintenance vehicles are generally directed to perform work in diverse maintenance, conditioning and cleaning applications such as for flooring surfaces. In this disclosure, the term floor refers to any support surface, such as, among others, floors, pavements, road surfaces, ship decks, and other surfaces to be cleaned and the like.

Commonly floor or surface maintenance machines are constructed having a single surface conditioning appliance or system so as to only sweep, others to scrub, while still others only to polish or burnish. It is of course possible to construct a single surface maintenance machine to perform one or more of the aforementioned surface maintenance tasks. One example of a multi-task floor conditioning machine is disclosed in U.S. Pat. No. 3,204,280, entitled "Floor Cleaning & Waxing Machine," the entire disclosure of which is incorporated by reference herein in its entirety for any and all purposes. Another is disclosed in U.S. Pat. No. 5,483,718, entitled, "Floor Scrubbing Machine Having Impact Energy Absorbtion," the entire disclosure of which is incorporated be reference herein in its entirety for any and all purposes. Disclosed therein is a forward mounted scrubber assembly that is followed by a squeegee assembly.

Scrubbing systems are well known in the art. Scrubbing systems commonly include a driver assembly and a rotatable scrubber in the form of a brush, pad, or the like. A control device may be utilized for controlling the degree of scrubbing (typically a function of down force applied through the scrubber) applied to a floor surface depending upon the type and/or condition of floor surface intended to be scrubbed. The scrubber driver assemblies for scrubbing systems are well known in the art and commonly include one or more rotatable brushes driven by a driver motor affixed to a scrubber head. Scrubber heads of the prior art have been selectively raised and lowered by an actuator coupled to the driver so as to achieve an intended down force or scrubbing pressure of the scrub pad against a floor surface. Examples of the latter are taught in U.S. Pat. Nos. 4,757,566, 4,769,271, 5,481,776, 5,615,437, 5,943,724, and 6,163,915, the entire disclosures of which are incorporated by reference herein in its entirety for any and all purposes.

Limit switches have been used to determine the relative position of the actuator tool. Limit switches are mechanical switches and, depending particularly on the operating environment, may be prone to damage or failure. Some limit switches are integrated within the housing of linear actuator to minimize damage or obstruction of the switch contacts. In some applications, a pair of limit switches can be used to determine the end of range positions of the actuator. In such applications, the pair of limit switches are unable to provide information as to actuator tool position within the range of limits.

Accordingly, it would be desirable to provide an apparatus and method for determining the position of an actuator or tool controlled by an actuator. Additionally, it would be desirable to eliminate the use of one or more limit switches to determine actuator or tool position.

SUMMARY OF THE INVENTION

The present invention relates to an efficient structure and method for determining the approximate relative position of an actuator tool, such as a working head in engagement with a surface to be cleaned. The invention further relates to a method of using a control structure to determine the actuator tool position while performing tasks of surface cleaning, surface maintenance, surface conditioning and the like. While the present invention is described and depicted primarily with reference to a cleaning head, the present invention finds diverse application in the art of surface cleaning, maintenance, conditioning and the like. Accordingly, the present invention is readily adaptable to a machine having one or more of the following applications, including without limitation, such cleaning heads designated and adapted to: burnish, polish, scrub, sweep, brush, treat and wipe a surface to be cleaned wherein an ability to determine the position of the working tool is beneficial. Of course, such cleaning head implements or cleaning head appliances may each be provided with an embodiment of the present invention and coupled to a single dedicated surface maintenance vehicle or to more than one such cleaning head coupled to a single vehicle.

In one embodiment, the invention is particularly applicable to a floor scrubbing machine having a scrub head mounted in front of the machine chassis. The scrub head includes a scrub brush or pad and a scrub driver. A linear actuator is utilized to raise and lower the scrub head relative to the floor surface.

Estimating the position of the actuator is a key element in the control strategy of the present invention The reliability of a motion control system can be greatly enhanced by increasing the accuracy of the linear actuator position estimation according to the present invention. Adding external components (sensors, limit switches, etc.) has a negative impact on machine reliability. By monitoring actuator voltage and current, the impedance of the actuator motor can be mathematically determined (R=V/I). As the load on the motor changes, the relationship between the applied motor voltage and speed diminishes. The impedance of the motor is a more accurate indicator of speed, regardless of motor load.

The linear actuator control system of the present invention performs the steps of measuring motor voltage, measuring motor current, using a mathematical formula, or table, or both to estimate motor speed, and integrating the speed over time to determine the approximate position of an actuator or tool controlled by an actuator. While the actuator motor is in operation, the voltage applied to the motor, and the current drawn by the motor are measured. From the measured voltage and current information, the impedance of the motor can be calculated (R=V/I). The impedance of the motor is approximately proportional to the motor speed. By continuously assessing motor speed, the actuator position may be determined via integration of motor speed and time data.

The present invention provides several advantages over both prior art and contemporary apparatus for determining relative tool position. The present invention may be implemented without physical limit switches. As a result the present invention is generally lower cost, easier to maintain and less prone to breakage than prior art (and complex contemporary) cleaning head position determining mechanisms and algorithms.

DETAILED DESCRIPTION OF THE PREFERRED EMBODIMENTS

Figure 1:
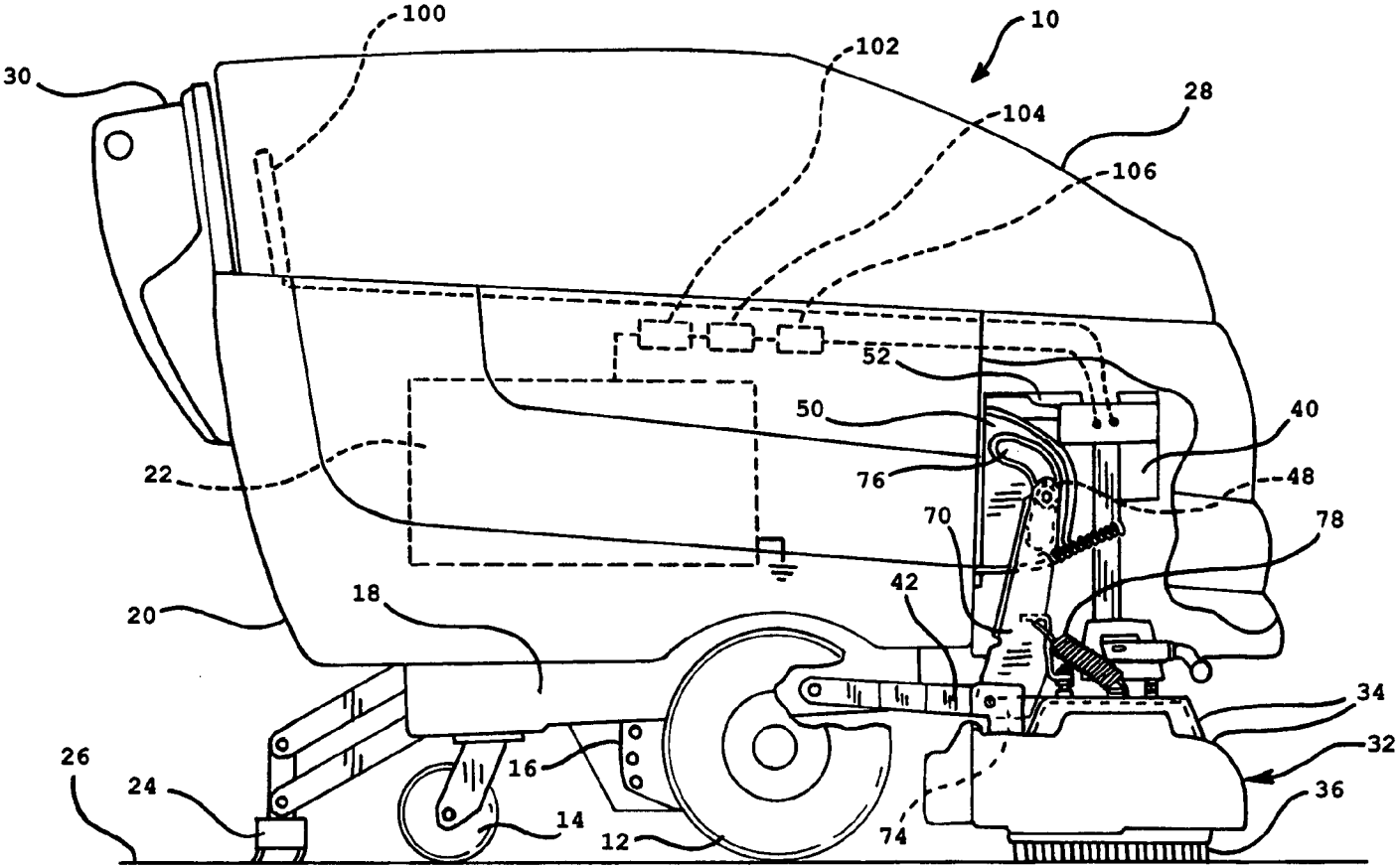
FIG. 1 is a side elevation view of a surface maintenance vehicle having a cleaning head coupled to said vehicle and incorporating aspects according to the present invention.

A floor scrubbing machine which uses the present invention is shown in normal operating position in FIG. 1. The scrubbing machine 10 has two front wheels 12 and two rear caster wheels 14, and a transaxle 16 providing traction drive to the front wheels. The transaxle and rear casters are attached to a frame 18, which supports a housing 20. This housing encloses rechargeable batteries 22 which supply energy to power the machine. It also contains a recovery tank to hold soiled scrub water recovered by a vacuum squeegee 24 from a floor 26 being scrubbed. A hinged lid 28 contains a tank for clean scrubbing solution to be dispensed to the floor and a vacuum fan to lift soiled scrub water from the floor via the squeegee 24 and deposit it in the recovery tank. A control console 30 provides necessary controls for an operator who walks behind the scrubber.

Figure 2:
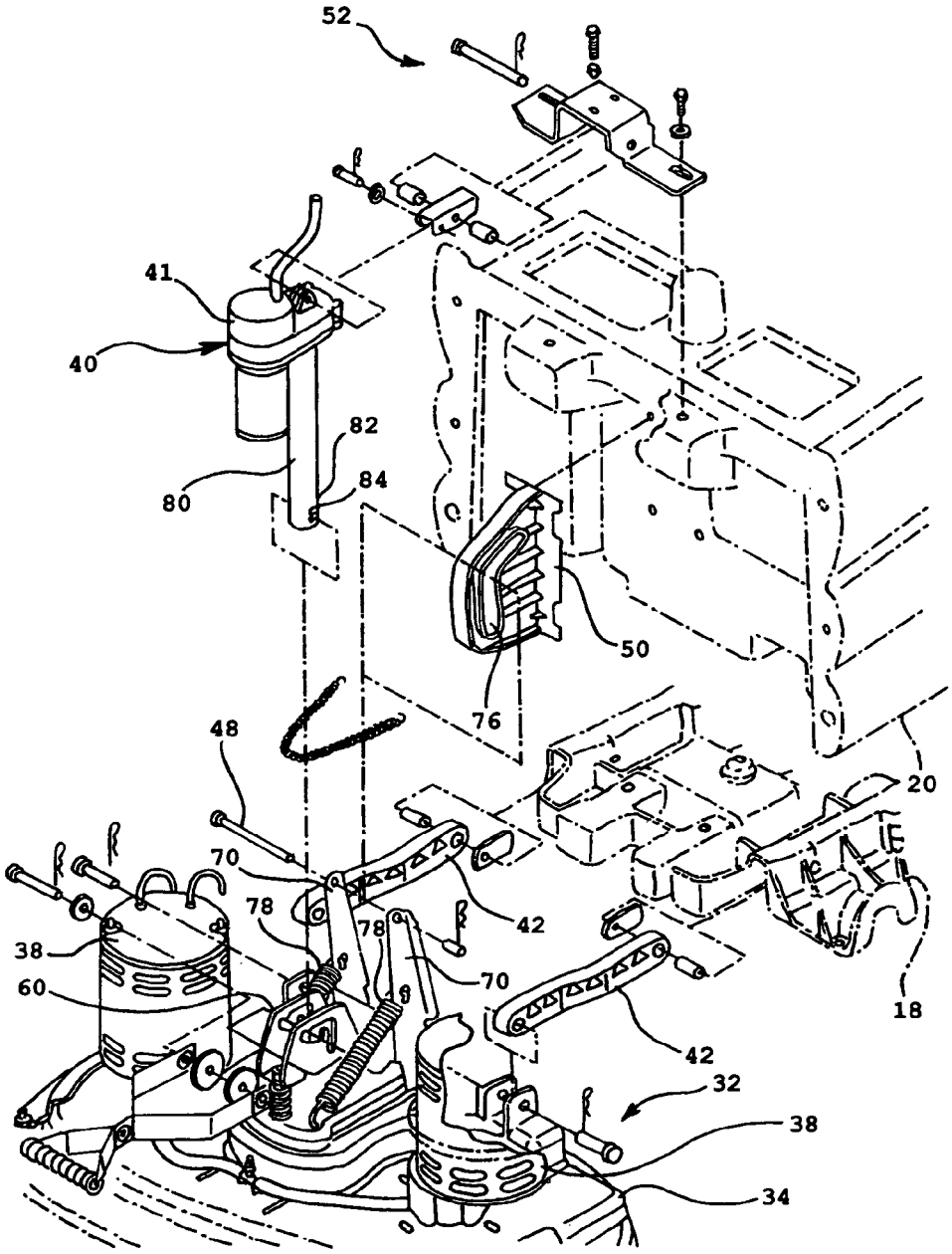
FIG. 2 is a perspective view of portions of the surface maintenance vehicle of FIG. 1 shown in an unassembled, exploded view adjacent the frame of a surface maintenance vehicle and wherein coupling between such parts is shown in ghost.

A scrub head 32 is shown in FIG. 1 in position to scrub the floor 26. A housing 34 encloses two scrub brushes 36. The brushes 36 are driven by two electric motors 38 which are shown in FIG. 2 (but omitted for clarity in FIG. 1). An electric linear actuator 40 attached between the scrub head 32 and the housing 20 raises the scrub head 32 for transport, lowers it for work, and controls its down pressure on the floor. Linear actuator 40 includes an electric motor 41. Additional aspects of the electric actuator 40 and associated mechanical coupling are described in more detail hereinafter.

The scrub head 32 as illustrated in FIGS. 1–2 uses two disk scrub brushes 36 rotating about parallel vertical axes. Alternatively, scrub heads may be made with only one disk scrub brush, or one or more cylindrical brushes rotating about horizontal axes. All of these variations can be applied to this invention. The illustrated scrubber is a relatively small model, controlled by an operator walking behind it. Scrubbers are made in much larger sizes, some of which have the operator riding on them. Again, the invention can be applied to larger machines if the essential elements of the invention are observed. While a scrub head 32 is depicted in FIGS. 1–2, any appliance or tool for providing surface maintenance, surface conditioning, and/or surface cleaning to a surface may be controlled in an associated machine or vehicle in accordance with the present invention.

The scrub head 32 is attached to the frame 18 by a coupling structure which allows it to be raised and lowered and allows the brushes 36 to conform to undulations in the floor 26. The scrub head 32 is attached to the frame 18 by lower control arms 42, a guide linkage 48, 50 and electric linear actuator 40 and associated coupling structure, including an upper mount assembly 52 for securing one end of the linear actuator to the housing 20, and a lower bracket 60 for securing the other end of the linear actuator 40 to the scrub head 32. Additional aspects of the lower bracket 60 are provided hereinafter. The two lower control arms 42 are attached to the frame 18 and the scrub head housing 34 with pivoted connections at their ends. Two upright arms 70 are also connected to scrub head 32. Guide 50 is attached to the front wall of the housing 20. Guide 50 provides a slot 76 within which roller 48 can move up and down. This slot 76 has an arcuate lower portion which is generally vertical and an upper portion which slopes up and toward the rear. During normal operation roller 48 rides more or less midway in the lower portion of slot 76, where it moves through the same arc as the front pivots of arms 42 to keep the brushes 36 and scrub head 32 parallel to the floor 26 as the scrub head 32 rises and falls while passing over any undulations in the floor. Two springs 78 are attached between the scrub head housing 34 and the arms 70. Since the arms 70 are constrained at their upper ends by slot 76 and at their lower ends by pivot 74, the action of springs 78 is to tend to tilt the forward part of the scrub head upward around pivot 74. Scrub head 20 is caused to tilt when it is raised to ease access to the components thereof by an operator of vehicle 10. Additional aspects of the scrub head are disclosed in U.S. Pat. No. 5,483,718, incorporated by reference herein.

Linear actuator 40 is used to raise the scrub head 32 for transport, lower it for work in a first operational mode, and controls its down pressure on the floor in a second operational mode, such as disclosed in U.S. Pat. No. 6,618,888, incorporated by reference herein. Linear actuator 40 preferably is an electric actuator having a leadscrew member 80. As in known in the art, leadscrew member 80 has a thread set formed thereupon and has a distal end 82 which is movable in response to leadscrew 80 rotation. The distal end 82 of leadscrew member 80 has a pin-receiving aperture 84 formed therein. A pin received within aperture 84 engages bracket 60 to operatively couple the scrub head 32 to housing 20/frame 18. Electric motor 41 of linear actuator 40 is controlled via controller 100. Electric motor 41 is operatively coupled to the batteries 22 via a controlled switch 102. Voltage data and current data of electric motor 41 may be presented to controller 100 by voltage sensor 104 and current sensor 106 which are shown in phantom lines in FIG. 1 as one of ordinary skill in the art would appreciate a variety of sensors which could be used to determine motor 41 voltage and current draw.

Estimating the position of the actuator 40 is a key element in the control strategy of machine 10. The reliability of a motion control system can be greatly enhanced by increasing the accuracy of the linear actuator 40 position estimation. Adding external components (sensors, limit switches, etc.) has a negative impact on machine 10 reliability. By monitoring actuator voltage and current, the impedance of the actuator motor can be mathematically determined (R V/I). As the load on the motor changes, the relationship between the applied motor voltage and speed diminishes. The impedance of the motor is a more accurate indicator of speed, regardless of motor load.

The linear actuator control system of the present invention performs the steps of measuring motor voltage, measuring motor current, using a mathematical formula, or table, or both to estimate motor speed, and integrating the speed over time to determine the approximate position of an actuator or tool controlled by an actuator. While the actuator motor is in operation, the voltage applied to the motor, and the current drawn by the motor are measured. From the measured voltage and current information, the impedance of the motor can be calculated (R=V/I). The impedance of the motor is approximately proportional to the motor speed. By continuously assessing motor speed, the actuator position may be determined via integration of motor speed and time data.

The linear actuator control system may include software, hardware, or combinations of both. The control system may be implement using a variety of digital and/or analog control devices. Controller 100 performs some of the functions necessary to determine estimated actuator 40 position. In one embodiment, a programmable digital controller may be programmed to implement the methods of the present invention to determine the approximate position of the actuator 40 or tool controlled by actuator 40. Those of ordinary skill in the art would appreciate that there are many ways to measure the voltage and current in a back-emf circuit.

Figure 3:
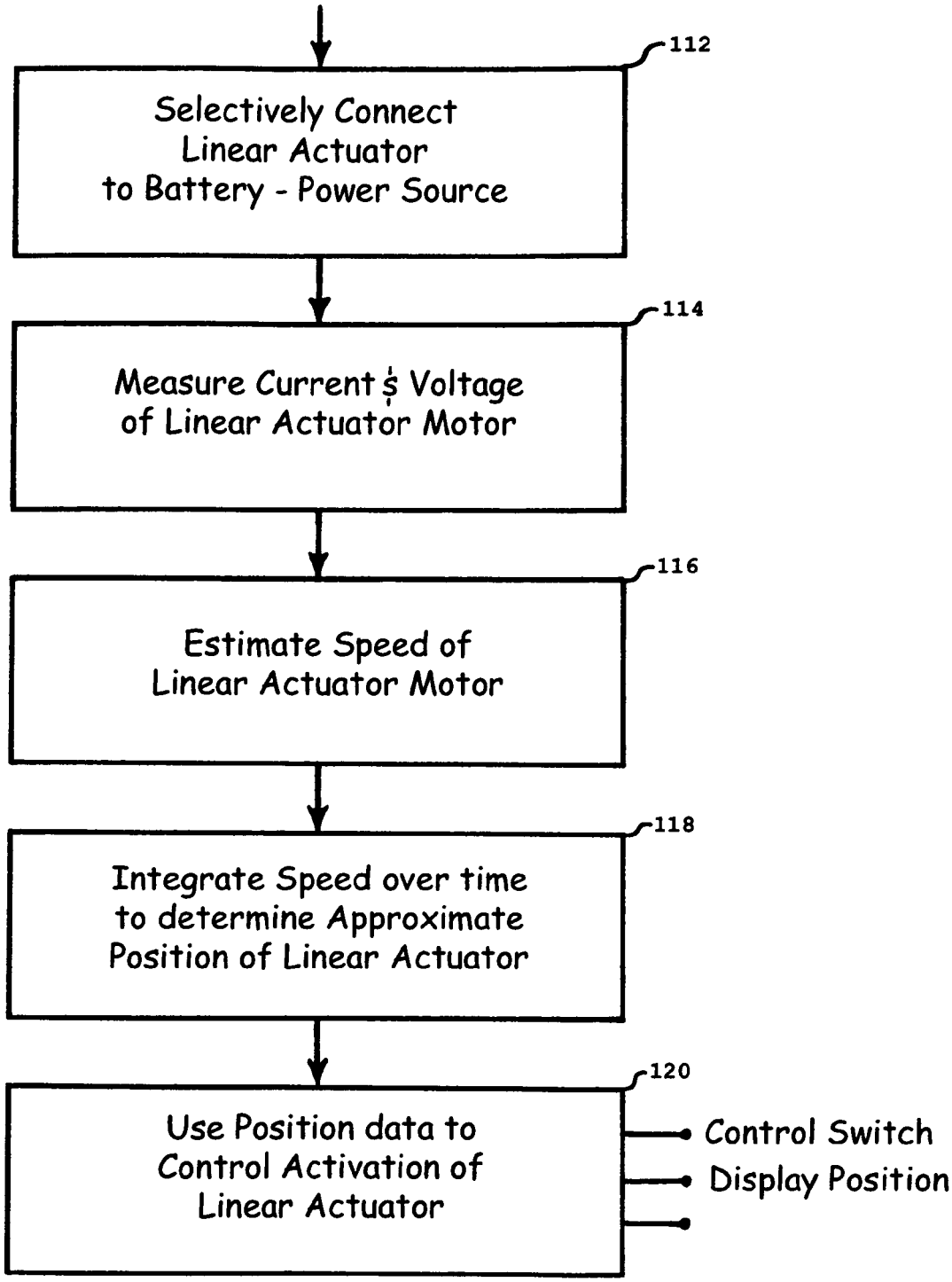
FIG. 3 is a flow chart of steps of the method of estimating linear actuator position according to the present invention.
Figure 4:
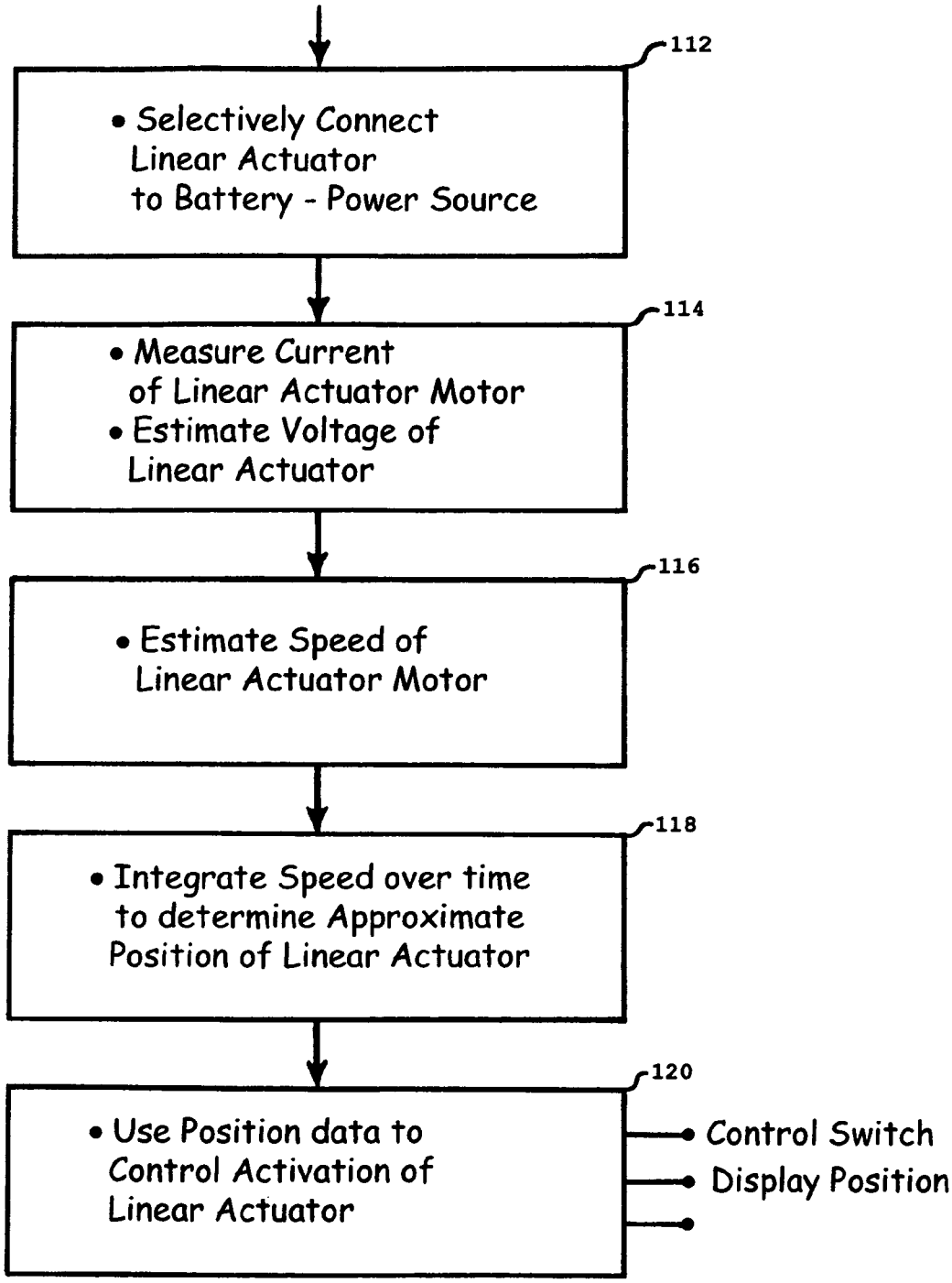
FIG. 4 is a flow chart of steps of another method of estimating linear actuator position according to the present invention.

FIG. 3 represents steps of one embodiment of a linear actuator control system according to the present invention. The linear actuator 40 is connected to the source of electrical energy (battery 22) in step 112. Controller 100 receives data representative of actuator current and voltage in step 114. Controller 100 utilizes the current and voltage data from step 114 to estimate the speed of actuator 40, as indicated in step 116. In step 118, the position of actuator 40 is determined by integrating speed data from step 116 over time. Controller 100 may use or pass position and/or speed data to subsequent devices. Controller 100 may also use the position data from step 118 to control activation of actuator 40, as indicated in 120. Those of ordinary skill in the arts would appreciate the various approaches to implementing such a control system utilizing hardware, software or a combination of both. For example, in another embodiment of the present invention the voltage applied across the electric motor of the linear actuator may be estimated (instead of directly sensed) with knowledge of the motor duty cycle. FIG. 4 represents steps of another embodiment of a linear actuator control system according to the present invention. In step 116, an approximation of motor voltage can be made by multiplying battery voltage and percent duty cycle by a correction factor, k. For example, motor voltage may be estimated by using the following formula: MV≈battery voltage×% duty cycle×k Additional advantages and modifications will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

We claim:

1. A control system for estimating the approximate relative position of an electric linear actuator on surface maintenance machine, said control system comprising:

the linear actuator having an electric motor which is selectively coupled to an electric power source;

means for controlling energy flow to the electric motor of the linear actuator from the electric power source;

means for measuring the current and voltage presented to the electric motor;

means for estimating the motor speed based on the measured values of current and voltage;

storage means for storing values of estimated motor speed; and integrating means for determining approximate linear actuator position, said integrating means integrating the motor speed over time to determine the approximate position of the linear actuator position.

2. The control system of claim 1 wherein the means for controlling energy flow to the electric motor includes an electronically controlled switch.

3. The control system of claim 1 further comprising:

means for storing measured values of current and voltage presented by the electric motor.

4. The control system of claim 1 further comprising:

means for storing approximate linear actuator position.

5. The control system of claim 1 further comprising:

means for displaying the approximate linear actuator position on a display screen visible to an operator.

6. A surface maintenance machine comprising:

a surface working head for engaging a surface to be cleaned;

a linear actuator operatively coupled to the surface working head for moving the surface working head relative to the surface;

a switch for selectively connecting an electric motor of the linear actuator to a source of electric power;

a current sensor;

a voltage sensor; and an electronic controller which accepts signals from the current and voltage sensors representative of the current and voltage of the electric motor when the electric motor is connected to the source of electric power, said controller estimating the motor speed based on the measured values of current and voltage, storing values of estimated motor speed and determining approximate linear actuator position by integrating the estimated motor speed over time.

7. The surface maintenance machine of claim 6 wherein the source of electric power is a battery.

8. The surface maintenance machine of claim 6 wherein the electronic controller controls the operation of the switch.

9. The surface maintenance machine of claim 6 further comprising:

a display for visually indicating the approximate position of the surface working head relative to the surface.

10. A method of determining an approximate position of a surface working head of a surface maintenance machine relative to the surface, said method comprising:

delivering electric energy to an electric motor of a linear actuator from an electric power source, said linear actuator moving the surface working head relative to the surface;

measuring current and voltage values presented to the electric motor when the electric motor is connected to the electric power source;

estimating the motor speed based on the measured values of current and voltage;

storing values of estimated motor speed; and integrating the motor speed over time to determine the approximate position of the linear actuator position.

11. The method of claim 10 wherein the step of delivering electric energy to the electric motor utilizes an electronically controlled switch.

12. The method of claim 10 further comprising the step of:

storing the measured current and voltage values presented by the electric motor.

13. A method of determining an approximate position of a surface working head of a surface maintenance machine relative to the surface, said method comprising:

delivering electric energy to an electric motor of a linear actuator from an electric power source, said linear actuator moving the surface working head relative to the surface;

measuring current presented to the electric motor when the electric motor is connected to the electric power source;

estimating voltage applied across the electric motor when the electric motor is connected to the electric power source using a combination of a measured battery voltage and a duty cycle supplied to the electric motor;

estimating the motor speed based on the values of current and voltage;

storing values of estimated motor speed; and integrating the motor speed over time to determine the approximate position of the linear actuator position.

14. A method of operating a surface maintenance machine comprising the steps of:

providing a portable surface working head for engaging a floor surface to be cleaned;

connecting an electric motor-based linear actuator to a source of electric power while the surface working head is moved across the surface;

determining current flow to the electric motor as the surface working head is moved across the floor surface;

determining voltage applied to the electric motor as the surface working head is moved across the floor surface; and inputting the current flow and voltage into an electronic controller, said controller estimating the motor speed based on the measured values of current and voltage, storing values of estimated motor speed and determining approximate linear actuator position by integrating the estimated motor speed over time.

* * * * *